US007340856B1

(12) United States Patent
Kalouris

(10) Patent No.: US 7,340,856 B1
(45) Date of Patent: Mar. 11, 2008

(54) ADJUSTABLE ATTACHMENT FOR HOLDER OF LIGHT OBJECTS

(75) Inventor: Nicholas Kalouris, Addison, IL (US)

(73) Assignee: American Gasket Technologies, Inc., Addison, IL (US)

( * ) Notice: Subject to any disclaimer, the term of this patent is extended or adjusted under 35 U.S.C. 154(b) by 0 days.

(21) Appl. No.: 11/433,246

(22) Filed: May 13, 2006

(51) Int. Cl.
*G09F 3/16* (2006.01)
*G09F 3/20* (2006.01)
*B65D 63/00* (2006.01)

(52) U.S. Cl. ..... 40/658; 40/316; 40/666; 26/534; 26/16 PB

(58) Field of Classification Search ..... 40/658, 40/647, 308, 316, 666, 661.12, 633, 669, 40/668; 24/543, 484, 16 PB, 17 A, 17 B, 24/DIG. 43
See application file for complete search history.

(56) References Cited

U.S. PATENT DOCUMENTS 3,973,293 A * 8/1976 Noorily ..... 24/16 PB
6,845,577 B1 * 1/2005 Downes ..... 40/316

* cited by examiner

*Primary Examiner*—Cassandra Davis
(74) *Attorney, Agent, or Firm*—IPHorgan, Ltd.; Vangelis Economou

(57) ABSTRACT

A merchandising tag holder for displaying information, suitable for mounting onto a wire display rack, having an elongated tab and a transition block having plural attachment positions for attachment of an attachment member, the attachment member being shaped to fit in one or another of the attachment positions in the transition block to make the mounting adjustable. The elongated tab is preferably of a flexible plastic material such as polyurethane, polyethylene or acrylonitrile butadiene styrene and the transition block includes two grooves for receiving the attachment member, enabling the elongated tab to extend to and be mounted around different diameter wire or metal rods on a wire display rack.

15 Claims, 2 Drawing Sheets

ADJUSTABLE ATTACHMENT FOR HOLDER OF LIGHT OBJECTS

BACKGROUND OF THE INVENTION

1. Field of the Invention

This invention relates generally to holders. More specifically, the present invention relates to a holder for planar or sheet material wherein the holder has a planar holder of the planar material and an adjustable attachment of the planar holder to a wire or rod, which may have a variable dimension.

2. Background Art

The inventive holder is particularly applicable to sign holders or display devices useful in retail environments in which price sheets and the like are to be displayed to prospective purchasers. However, it will be appreciated by those skilled in the art that the invention has broader applications, and may be utilizable in other applications in which it is convenient to hang items from a variable dimensioned mounting using a cinch or contoured tab.

Conventional practice for retail establishments is to indicate the price of merchandise held on shelves with price tags attached to the shelf by some sort of clip or rigid holder. In some instances, the rigid holder is in the form of a planar member that has cantilevered top and bottom edges forming grooves into which price tags, for example, small rectangular sheets of paper or cardboard are inserted. The price tags are usually positioned in a plane parallel to the shelf front edge or in a plane perpendicular to the front edge to call the prospective purchaser's attention to the price of the merchandise goods that are usually disposed directly behind the price tag holder. Price tags need to be mounted securely to prevent accidental dislodgment by passersby or as a result of deliberate tampering by persons bent on mischief. Known price tag holders utilize mechanical locking means, for example, a pin and slot arrangement, to prevent the removal of the price tag except by manually disengaging the locking means. Some such clips are made from several parts to facilitate the removal of sheets. However, multiple part arrangements of this type add to the costs, as they require assembly and other steps to produce than does a one piece device.

Conventional one piece price tag holders, for example, tags that are attachable to themselves around a wire mesh front wire in a wire mesh shelf have a specified diameter wire or metal rod to which they are attachable. If the diameter of the rods making up the wire mesh shelves is of a larger size, then a different size of attachment tab is necessary. Thus, to change over to a different shelving system requires obtaining a complete new set of price tag holders. Moreover, if two or several different types of shelving are utilized in a specified retail establishment, then as many types of price tag holders are necessary to use on the different wire mesh holders, thereby needlessly complicating the inventory of the retail establishment, adding to the carrying costs and taking up space that would otherwise be used for storage of retail merchandise.

None of the prior art methods known heretofore teach an adjustable tab for a price tag holder that can be utilized for more than one size of wire mesh by adjusting the attachment of the price tag holder. Additionally, no known price tag holders provide such an arrangement in which the tabs of the holders are utilizable for different size wires in a unitary, compact arrangement that is easy to use by personnel of the retail establishment and hard to tamper with by others.

SUMMARY OF THE INVENTION

Accordingly, there is provided an adjustable holder for light objects, such as merchandise display tags, suitable for mounting onto a wire display rack, the display tag holder comprising a display portion and a connecting portion connected to the display portion and having an elongated tag, the tab including a proximal end closest to the display portion and a distal end defining a longitudinal direction, the connecting portion further including a transition block having plural attachment positions for attachment of an attachment member, the transition block being connected to at the display portion and to the proximal end of the elongated tab, the distal end of the elongated tab including an attachment member adjacent thereto, the attachment member being shaped and dimensioned to be attached to at least one of said plural attachment positions.

In another aspect of the invention, the attachment portion further including two separate staggered attachment positions that comprise grooves for receiving a semi-cylindrical pin that is contiguous with a terminal handle at the distal end of the elongated tab. In a preferable configuration, the inventive merchandise display tag holder is one integral part and comprises an injection molded plastic, such as polyurethane, or acrylonitrile butadiene styrene.

BRIEF DESCRIPTION OF THE DRAWING FIGURES

DETAILED DESCRIPTION OF THE PREFERRED EMBODIMENTS

Figure 1:
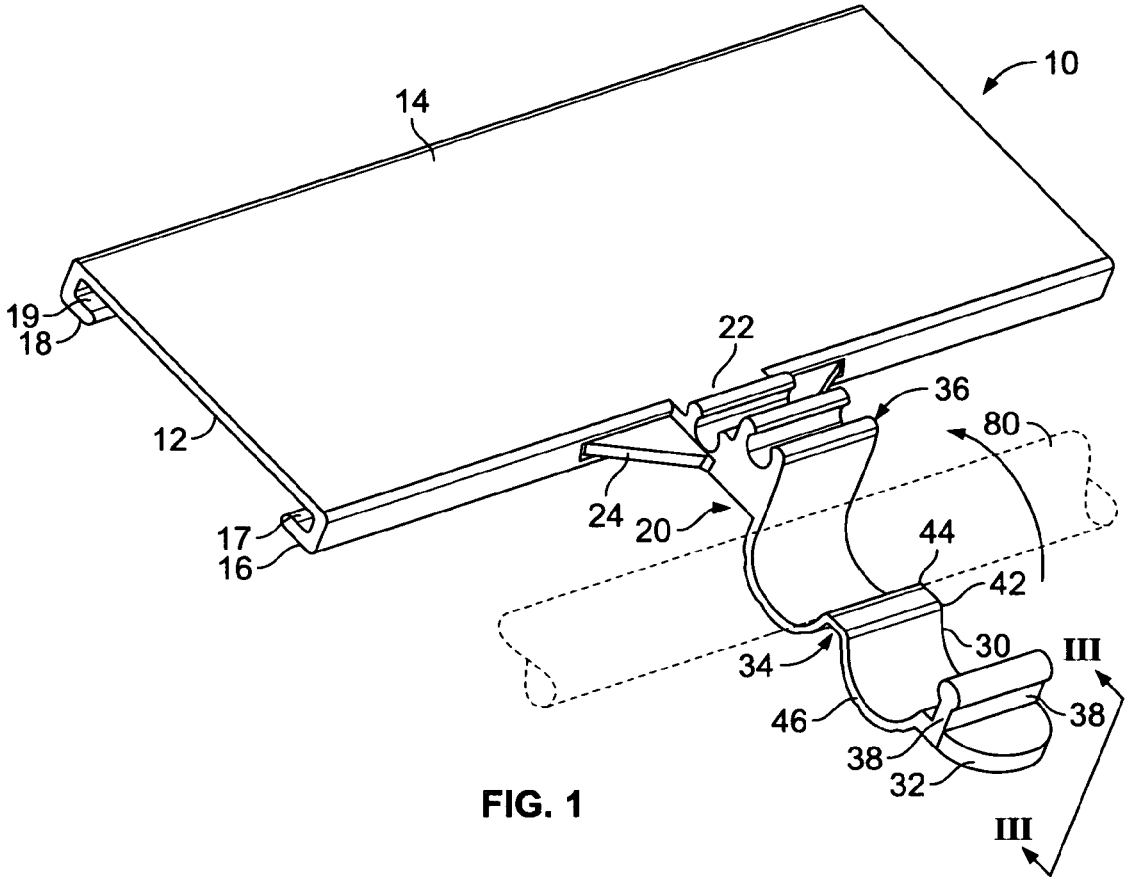
FIG. 1 is perspective view of a price tag holder according to the present invention.
Figure 2:
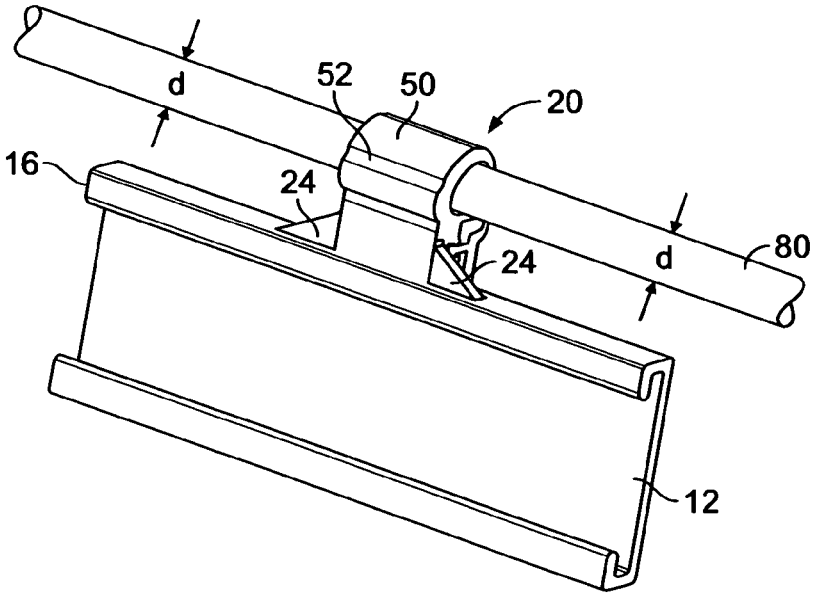
FIG. 2 is perspective view of a price tag holder according to the present invention shown as used in a retail environment.

Referring now to FIGS. 1 and 2, an embodiment of the present invention price tag holder 10 is shown. A price tag portion 11, comprising a front surface 12 for displaying price information, and an opposed back surface 14 of the price tag portion 11, is shown in FIG. 1. The price tag portion 11 may take any shape, but is preferably in the shape of a rectangle, as shown. The extending sides of the price tag portion 11 have cantilevered, or turned over edges, namely a top edge 16, and a bottom edge 18, each defining opposed grooves 17, 19 respectively. The opposed grooves 16, 17 provide a slot for inserting price tag information, in the form of a paper or cardboard tag. The price tag portion 11, in and of itself, including the surfaces 12, 14, is conventional.

The top edge 16, at a central location along the transverse extent of the edge 16, includes an integral mounting attachment portion generally shown at 20, which attaches the tag display surface 14 to a wire mesh 80 (shown in phantom in FIG. 1) of a merchandising display. The wire mesh 80 is under normal circumstances the first wire of an arrangement of wires that are usually weldable to each other in a configuration forming wire shelves on which retail merchandise is displayed. The price tag display portion 11 thus normally will hang form the first wire 80, as shown in FIG. 2, in front of and above the merchandise on the shelf immediately below the wire 80. The configuration of the inventive price tag holder 10 provides tight interference fit around the wire 80 to retain the holder 10 in position so it does not swing about the wire nor moves laterally along the wire 80, as will be described below in more detail.

Figure 3:
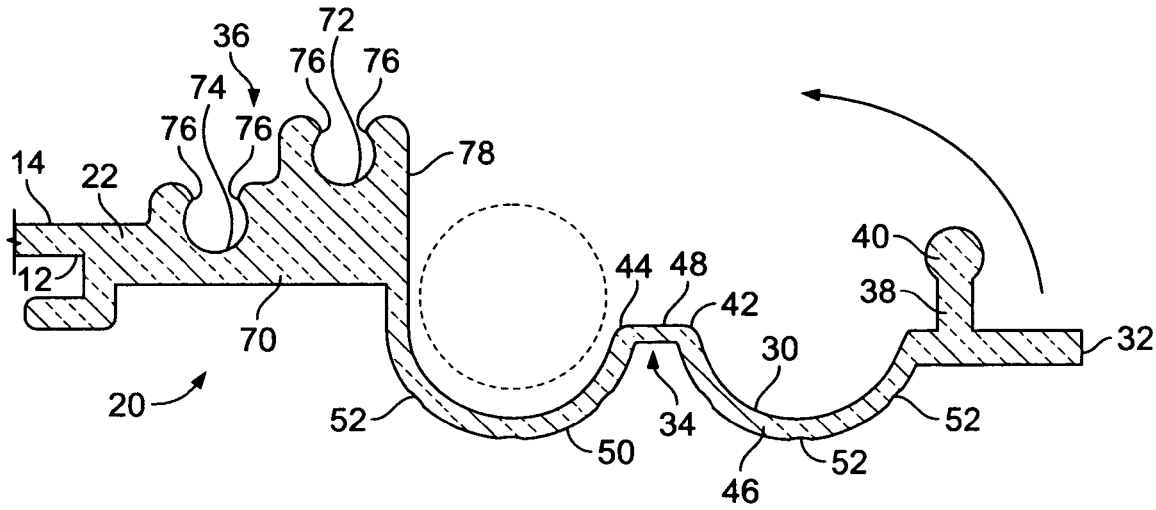
FIG. 3 is a cross-sectional side view of the price holder according to the present invention, taken approximately along the line 3-3 of FIG. 1.

Referring now to FIGS. 1 and 3, the inventive display tag holder is described in detail, including the configuration and operation of the mounting attachment portion 20. The mounting attachment portion 20 is firmly attached to the price tag portion 11 through an integral tab connection 22. The tab connection is attached centrally to the top edge 16 of the price tag portion 11, as shown, in a preferably integral connection, although the connection may be through any other appropriate means. Optionally, and preferably, two supports 24 one on either side of tab 22 are attached directly to the top of the edge 16 and to the longitudinally extending sides of the tab connection portion 22 to provide added support to the connection.

The mounting attachment portion 20 comprises a unitary elongated tab 30 that is extending longitudinally away from the connection to the top edge 16 at the tab connection 22. The mounting attachment portion 20 preferably is integral with the tag holder portion 11 at one end by way of a unitary or integral block 70. The mounting attachment portion 20 is thus more solidly attached to the tag display holder 11 so that any forces tending to detach the tab portion 30 from the display tag portion 11 are dissipated in the construction of the apparatus. The other end of the tab 30 is a tab end 32 that is capable of being folded over itself to attach to the appropriate locations on the mounting attachment portion 20, as will be described below.

The integral tab connection 22 is preferably attached to the end of the block 70 that is closet to the mounting attachment portion 20. The tab handle 32 is shown as being in the shape of a semicircle, which is a preferable, but any other appropriate shape, for example, a rectangle, truncated pyramid or triangle may also be utilized. The tab 30 includes a number of features that enable the longitudinally extending tab 30 to lock onto itself in a semi-permanent attachment around an attachment point, for example, a metal rod or wire that comprises shelving in a merchandising retail establishment.

Figure 4:
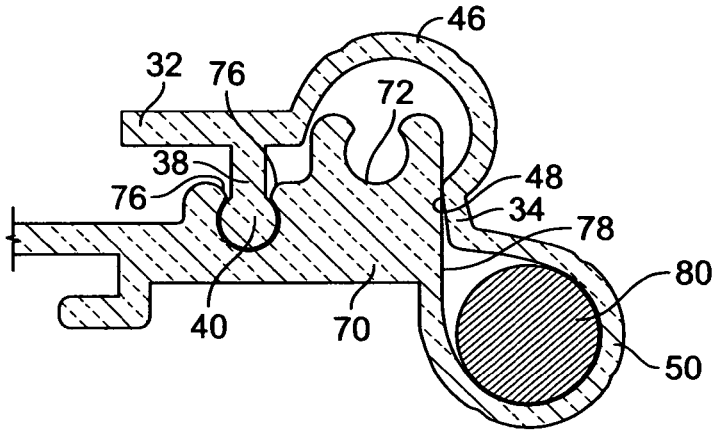
FIG. 4 is a cross-sectional side view of the price holder according to the present invention attached to a wire of one diameter at a first attachment position.
Figure 5:
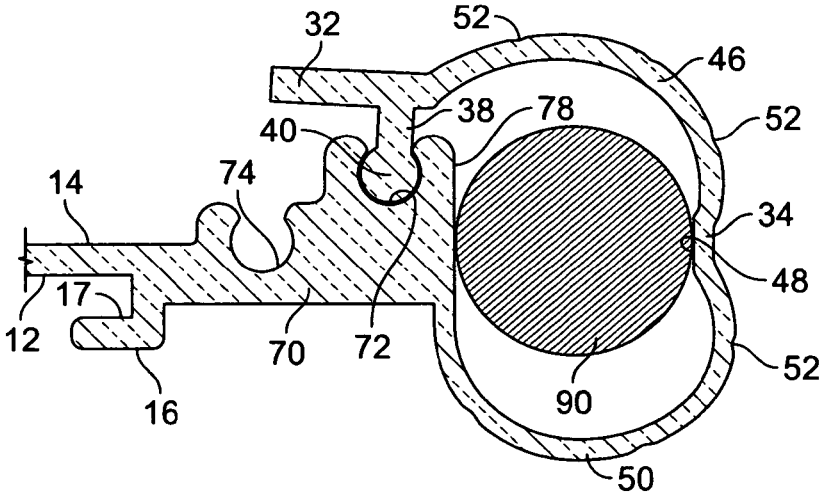
FIG. 5 is a cross-sectional side view of the price holder according to the present invention attached to a wire of a second diameter at a second attachment position.

A tab 30 is shown in the perspective view of FIG. 2, after having been connected to the mounting attachment portion 20, and is shown in greater detail in the cross-sectional views of FIGS. 4 and 5. The elements of tab 30, as are the remainder of the preferably integral price tag holder 10, are preferably made form an extruded hard plastic, for example, polyurethane, and the ability to fold over itself is enhanced by the dimensions of the tab 30, being thin relative to the block 70, as seen in profile (FIGS. 1 and 3-5). Additionally a scored double fold section 34, best seen in FIG. 3, provides a score line for the tab handle end 32 to be folded over in the direction of the arrow and to attach itself to the attachment portion 36, which is disposed proximately to the tag display portion 11 by the tab connection 22.

Adjacent the tab handle end 32 is an upstanding post or tongue 38 that ends in an elongated, essentially cylindrical pin 40, which extends transversely to the longitudinal extension of the tab 30. In the profile view shown in FIGS. 3-5, the tongue 38 is shown as a post that ends in a ball that represents the pin 40 disposed on the upper end of the tongue 38.

The scored double fold section 34 preferably comprises two separate scored lines 42, 44 that define a central bridge section 48 between them, and also define the separation of each of the adjacent tab sections 46 and 50. The score fold lines 42, 44 provide a place for the flexing of the tab 32 so that the sections 46, 48 and 48, 50 can be bent consistently and easily relative to each other, so as to permit the folding over of the tab 32. They relative bending of the sections is best seen in the profile cross-sectional view of FIG. 5 in which the attachment section 20 is shown attached to a large diameter rod 90. The easy bending of the semi circular tab sections are also assisted because of the relative thinness of the sections 46, 50 and bending is also facilitated by grooves or score lines 52 that extend across the width of the sections, as shown.

The attachment portion 36 comprises a block 70 to which the semicircular section 50 is attached by means of the tongue 38 and 49 arrangement. The block 70 includes two grooves 72, 74 that extend transverse to the longitudinal length of the tab 30 and an end wall 78 that is directly connected to the semicircular section 50. Block 70 remains rigid relative to the display portion surfaces 12, 14, and the grooves 72, 74 provide attachment points for receiving the transversely extending pin 40. The two transversely extending grooves 72, 74 correspond in shape and size to the pin 40. As shown, the grooves 72, 74 are in a staggered relationship in the shape of slots that are similar to a stairstep. When viewed in profile as in the cross-sectional views of FIGS. 3-5, the second groove 74 is positioned lower and to the left of the first groove 72.

Grooves 72, 74 are defined by semicircular slots that are in profile in the shape of a cove that has a circular arc that extends about 75% of the complete circle, where the two rounded corners 76 of each groove 72, 74 define the opening for receiving the tongue 38 and pin 40 combination. As best seen in the cross-sectional views, the two corners 76 form an inlet opening that is smaller than the diameter of the cylindrical pin 40 and may be similar in the separation distance to the width of the tongue 38. Thus, when the pin is depressed into the slot of the groove 72 or 74, the pin is securely attached in the slot and the corners each provide an interference fit to the sides of the tongue 38. Once the pin 40 is inserted into the slot formed by the grooves 72 or 74, it is contained in place therein until sufficient manual force is exerted on the tab handle 32 to withdraw the pin by overcoming the resistance to deformation of the corners 76. Thus, once attached in the groove around a rod 80 or 90, the elongated tab 30 provides a tight interference fit to retain the tab in place, as shown in FIGS. 4 and 5, respectively.

While a single position display tag holder is known in the art, it is a significant feature and a distinct advantage to have a unitary display tag holder, such as holder 10, that can be used with a great variety of rods or wires without significantly sacrificing any of the features that make a conventional, unitary, single size and position display tag holder (not shown) desirable. Specifically, the display tag holder 10 according to the present invention continues to provide a tight interference fit against he rod or wire 80, 90 irrespective of the size or rod diameter, while simultaneously retaining the connection of the tongue 38, pin 40 combination within one or another of the grooves 72 or 74. The attachment must be durable enough so as to prevent the accidental or even mischievously deliberate removal of the display tag holder 10 from a wire 80, 90, whether by inadvertent contact or by a person bent on mischief, who can attempt to pull on the display tag holder from its connection.

Ideally the attachment will be capable of being detached only by a user who first withdraws the cylindrical pin 40 from the groove, either 72 or 74. This will only be don by pulling on the handle end 32, and then by rotating the connecting tab 30 to unwind it from the rod or wire 80 or 90.

The unique configuration of the inventive tag holder as shown in FIGS. 4 and 5 provide for the two different attachment positions of the pin so as to provide the adjustability of the attachment of display tag holder 10 of the present invention. As shown in FIG. 4, a first type of wire or rod 80, as shown in cross-section, which may be the foremost wire of a standard mesh wire merchandising shelf, provides an attachment base to which the display tag holder is attached. If a typical type of wire having a specified diameter were used, then the first attachment position using groove 74 would be the one into which the pin 40 would be inserted. The insertion of the cylindrical pin 40 into groove 74, furthest form the block end wall 78, and would require that the handle end 32 be pulled over the second attachment position in groove 72. In this attached position, the tongue 38 will extend directly through the gap defined by rounded corners 76, and the semicircular tab section 50 will require extension and bending of the score lines 42, 44 to enable the tab 30 to reach over the full extent of the block 70. The other semi-circular section 52 is bent inwardly to engage the wire 80 as much as possible around its surface. While the central bridge section 34 of tab 30 is shown in contact with the end wall 78 of the block 70, such contact is dependent on a wire having a particular diameter, e.g. ¼ inch, as can be understood by those having skill in the art, a slightly larger diameter is also capable of accommodation, by achieving a tight interference fit. This is enabled by the shape of tab 30 and the close fit contact of the metal wire or rod with the central bridge section 34. The tension provided by the flexibility and resilient force of the bent sections 46, 50, as a result of the engagement of the pin 40 into the appropriate groove 72, 74. A smaller rod would allow the tab 30 to curve inwardly and so by the tension on the curved semicircular sections 46, 50, would cause pressure to be exerted on the rod, whether 80 or 90.

When as larger diameter rod, for example, rod 90, is the attachment point, of course, the upper or second attachment groove 72 will be the point at which receive the pin 40. Because of the orientation and disposition of this attachment, more of the longitudinal extending tab 30 will be required to encircle the larger diameter rod 90, and this also provides for the position of an inner wall 48 of the central bridge portion 34 to contact the rod squarely at its outer diameter. The tension of the two curved semicircular sections 46, 50 as concentrated in the contact point of wall 48 produces a pressure on the rod in a generally inwardly radial direction, and thus tending to bias the rod 90 against he end wall 78 of the block 70. As shown in FIG. 5, if the rod 90 is of even larger diameter, the elongated tab 30 can accommodate it by a greater bending of the score lines 42, which would create a larger sized semicircular section enclosure of the rod 90.

Conversely, when the wire or rod has a smaller diameter, for example, as does rod 80 shown in FIG. 4, the curved semicircular section 50 closest to the end wall 78 by itself essentially encircles the rod 80 and the inner wall 48 of the central bridge portion 34 may come into contact with the end wall 78. Should a rod 80 have a slightly larger diameter, the configuration of the elongated tab 30 can accommodate the different diameter by a slightly more angular bending of the score lines 42, 44, and also of the curved semicircular sections 46, 50 at the score lines 52, if necessary. Of course, if the diameter is greater than the partial circumference of the inner wall of the curved semicircular section 50, then the wall 48 will not come into contact with the end wall 78.

The invention herein has been described and illustrated with reference to the preferred embodiments of FIGS. 1-5, but it should be understood that the use of the invention is susceptible to modification, alteration or substitution of the attachment configuration without departing significantly from the spirit of the invention. For example, the dimensions, size and shape of the various elements may be altered to fit specific applications. The shape of the rod to which the present invention may take a different shape, for example, an oval or octagonal or even square cross-section, and the inventive attachment section can accommodate it by the contact made by the central bridge section 34 against a surface of the unsymmetrically shaped rod.

The shape of the pin 40 may also be changed to achieve other necessary goals. For example, to further inhibit mischief or removal of the display tag form a store shelf. For example, rather than using the semicircular pin 40 shown in FIGS. 3-5, a triangular pin (not shown) may be used. That is, a pin, which is triangular in profile, may have a corresponding shape that is shaped and dimensioned in the grooves, with the apex of the triangle being inserted into a triangular groove in the block 70. The other two corners of the triangle can engage two overhanging lips (not shown) so that the triangular shaped pin would be trapped in the groove and an attempt to remove pin form the groove would cause damage to the attachment such that it could not be reused. Other modifications will be apparent to those of ordinary skill, and accordingly, the specific embodiments illustrated and described herein are for illustrative purposes only and the invention is not limited except by the following claims and equivalents thereof.

What is claimed is:

1. A merchandise display tag holder suitable for mounting onto a wire display rack, the display tag holder comprising a display portion and a connecting portion adjustably connected to the display portion and having an elongated tab, the elongated tab including a proximal end closest to the display portion and a distal end so as to define a longitudinal direction, the distal end of the elongated tab including an attachment member adjacent thereto, the connecting portion further including a transition block having plural attachment positions for adjustable attachment of the attachment member of the elongated tab, the transition block being connected to the proximal end of the elongated tab, the attachment member of the elongated tab being shaped and dimensioned to be adjustably attached to at least one of said plural attachment positions, and the display portion being connected to the block at a position removed from said plural attachment positions.

2. The merchandise display tag holder according to claim 1 wherein said plural attachment positions further comprise two attachment positions that are longitudinally staggered and at a different height in relation to a plane defined by the elongated tab when in an unconnected position.

3. The merchandise display tag holder according to claim 1 wherein the display portion is generally flat for receiving an information display and extends from said transition block in a direction away from the attachment position.

4. The merchandise display tag holder according to claim 1 wherein said distal end of the elongated tab includes a terminal handle and the attachment member is adjacent the terminal handle.

5. The merchandise display tag holder according to claim 1 wherein the display portion, the elongated tab and the transition block are integral.

6. The merchandise display tag holder according to claim 5 wherein the display portion, the elongated tab and the transition block are made from injection molded plastic.

7. The merchandise display tag holder according to claim 6 wherein the display injection molded plastic further comprises a material selected form the group consisting of polyurethane, polyethylene or acrylonitrile butadiene styrene.

8. The merchandise display tag holder according to claim 1 wherein the elongated tab has a predetermined thickness such that the tab can be bent to complete the connection about a wire of a wire rack merchandising display.

9. A merchandise display tag holder suitable for mounting onto a wire display rack, the display tag holder comprising a display portion and a connecting portion connected to the display portion and having an elongated tab, the elongated tab including a proximal end closest to the display portion and a distal end so as to define a longitudinal direction, the connecting portion further including a transition block having plural attachment positions for attachment of an attachment member, the transition block being connected to the display portion and to the proximal end of the elongated tab, the distal end of the elongated tab including an attachment member adjacent thereto, the attachment member being shaped and dimensioned to be attached to at least one of said plural attachment positions, wherein the attachment member is a semi-cylindrical pin and each of the attachment positions further comprise semicylindrical grooves for receiving the semi-cylindrical pin.

10. The merchandise display tag holder according to claim 9 wherein the display portion, the elongated tab and the transition block are integral.

11. A merchandise display tag holder for mounting onto a wire segment of a display rack, the wire segment being one of two diameters, the display tag holder comprising a display portion and a connecting portion connected to and extending from one side of the display portion and having an elongated tab, the tab having a proximal end closest to the display portion and a distal end furthest from the proximal portion, the axis from the distal portion to the display portion defining a longitudinal direction, the connecting portion further including a transition block having first or second attachment positions for adjustable attachment of a distal portion attachment member, the transition block being disposed intermediate the display portion and the proximal end of the elongated tab, the distal portion attachment member being shaped and dimensioned to be attached to at least one of said first or second attachment positions, depending on the diameter of the wire segment.

12. The merchandise display tag holder according to claim 11 wherein said distal end of the elongated tab has the distal portion attachment member disposed adjacent the distal end of the elongated tab.

13. The merchandise display tag holder according to claim 11 wherein said elongated tab defines a plane when the elongated tab is in an unconnected position.

14. The merchandise display tag holder according to claim 13 wherein said first or second attachment positions further comprise attachment positions for connection of the elongated tab that are longitudinally staggered and at a different height in relation to a plane defined by the elongated tab when the tab is in the unconnected position.

15. The merchandise display tag holder according to claim 11 wherein the elongated tab has a predetermined thickness such that the tab can be bent to complete the connection about a wire segment of a wire rack merchandising display, the connection being made in the first attachment position for a wire segment of a first diameter and in the second attachment position for a wire segment of a second diameter.

* * * * *